US006223721B1

(12) United States Patent
Bauer et al.

(10) Patent No.: US 6,223,721 B1
(45) Date of Patent: May 1, 2001

(54) METHOD AND DEVICE FOR CONTROLLING A DRIVE UNIT OF A VEHICLE

(75) Inventors: Torsten Bauer; Martin Streib, both of Vaihingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/297,863

(22) PCT Filed: Jul. 28, 1998

(86) PCT No.: PCT/DE98/02130

§ 371 Date: May 10, 1999

§ 102(e) Date: May 10, 1999

(87) PCT Pub. No.: WO99/13207

PCT Pub. Date: Mar. 18, 1999

(30) Foreign Application Priority Data

Sep. 10, 1997 (DE) ..... 197 39 564

(51) Int. Cl.[7] ..... F02D 41/24

(52) U.S. Cl. ..... 123/399; 123/406.51; 123/406.5; 123/492

(58) Field of Search ..... 123/399, 406.5, 123/406.51, 492, 350

(56) References Cited

U.S. PATENT DOCUMENTS

| | | | | |
|---|---|---|---|---|
| 5,101,786 | * | 4/1992 | Kamio et al. | 123/492 |
| 5,625,558 | * | 4/1997 | Togai et al. | 123/399 |
| 5,657,230 | * | 8/1997 | Hess et al. | 123/350 |
| 5,676,112 | * | 10/1997 | Bauer et al. | 123/350 |
| 5,692,471 | * | 12/1997 | Zhang | 123/350 |
| 5,692,472 | * | 12/1997 | Bederna et al. | 123/350 |
| 5,983,861 | * | 11/1999 | Nishio et al. | 123/350 |
| 6,065,446 | * | 5/2000 | Engl et al. | 123/350 |

FOREIGN PATENT DOCUMENTS 195 36 038 * 4/1997 (DE) .

* cited by examiner

*Primary Examiner*—Erick Solis
(74) *Attorney, Agent, or Firm*—Walter Ottesen

(57) ABSTRACT

A method and arrangement for controlling a drive unit of a vehicle are suggested. A desired torque value or a desired power value is formed on the basis of the driver command which serves to control the drive unit. A maximum permissible torque or a maximum permissible power is determined and the desired value is limited to the maximum permissible value when the desired value exceeds the maximum permissible value.

10 Claims, 6 Drawing Sheets

METHOD AND DEVICE FOR CONTROLLING A DRIVE UNIT OF A VEHICLE

FIELD OF THE INVENTION

The invention relates to a method and an arrangement for controlling a drive unit of a vehicle.

BACKGROUND OF THE INVENTION

Such a method and such an arrangement are known from U.S. Pat. No. 5,692,472. There, to control the drive unit, the torque or the power of the drive unit is adjusted electrically at least in dependence on the position of an operator-controlled element actuated by the driver. A maximum permissible torque or a maximum permissible power is determined on the basis of the position of the operator-controlled element as well as at least on the engine rpm. The maximum permissible torque or the maximum permissible power of the drive unit should not exceed the torque or the power during the actual operating state. The actually adjusted torque or the actually adjusted power of the drive unit is determined from operating variables such as engine rpm and the inducted air mass. This actual adjusted torque or power is compared to the maximum permissible value and a fault reaction is initiated when the computed torque or the computed power exceeds the maximum permissible torque or the maximum permissible power. With this monitoring measure, the operating reliability of the drive unit is ensured because a torque generation of the drive unit, which is increased compared to the driver command, can be prevented in a reliable manner. The response of the shown monitoring is only wanted in the actual case of a fault. In addition, operating situations are conceivable (for example, in transition states), in which the monitoring responds to tightly pregiven tolerances without a fault being present. Such a behavior is not wanted.

SUMMARY OF THE INVENTION

It is therefore an object of the invention to provide measures which avoid an unwanted response of the described monitoring.

A control system for an internal combustion engine on the basis of a torque orientated functional architecture is known from U.S. Pat. No. 6,098,592. Here, a drive desired torque is formed from the position of the operator-controlled element, which is actuated by the driver, while considering at least the engine rpm. This driver desired torque is logically coupled to external and internal torque requirements in the context of coordinators for the adjustment of charge and for interventions (for example, ignition angle) which are synchronous with the crankshaft. The resulting desired torques are then, for example, converted into desired ignition angle and desired throttle flap position. Such an engine control system is shown in FIGS. 1 and 2.

It is ensured that the monitoring on the basis of computed and maximum permissible torque or power only responds and a fault reaction is initiated when an actual fault is present via the limiting of at least one desired value for a torque of the drive unit to the maximum permissible torque (or via a corresponding measure when the engine control computes engine power values in lieu of torque values). In this way, the driving comfort and the availability of the drive unit are considerably increased. It is especially advantageous that the tolerances for the monitoring of the drive unit on the basis of computed and maximum permissible torque or power can be pregiven very tightly so that, for an actual fault condition in the region of the engine control, this fault condition can be recognized very quickly and countermeasures initiated very rapidly.

In addition, it is of special advantage that the torque desired values for the charge path as well as for the rapid intervention path via injection suppression, the influencing of the fuel metering and/or of the ignition angle are limited to the maximum permissible torque for an engine control system having a torque-orientated functional architecture. In this way, in transition situations and in special situations, the maximum permissible torque cannot be exceeded and therefore a response of the torque monitoring is effectively avoided. The same applies for a power-orientated functional architecture.

It is especially advantageous that a hysteresis between switching on the limitation and switching off the limitation is provided, preferably for the rapid intervention quantities.

In an advantageous manner, the influence of the engine drag torque control (MSR) is considered. When the drag torque control is active, the limiting is disabled because the engine drag torque control can increase the power. In this way, the engine drag torque function is not negatively affected. It is especially advantageous that it operates only in the rapid path and the MSR can increase the torque for a short time.

For an intervention wherein the ignition angle can be switched off, it is especially advantageous to make triggering the limiting dependent upon the torque to be adjusted via the ignition angle; whereas, the switchoff of the limiting is pregiven in dependence, inter alia, on the torque for the fuel metering which is computed on the basis of the accelerator pedal position. For a switched-off ignition angle intervention, the desired torque for the ignition angle is orientated on the torque without intervention on the base torque adjusted from preprogrammed characteristic fields. For this reason, a limiting of the actual torque to the base value is achieved. This contributes in an advantageous manner to the operational reliability.

BRIEF DESCRIPTION OF THE DRAWINGS

The invention will now be explained in greater detail with respect to the embodiments shown in the drawings. Here.

DESCRIPTION OF THE PREFERRED EMBODIMENTS OF THE INVENTION

Figure 1:
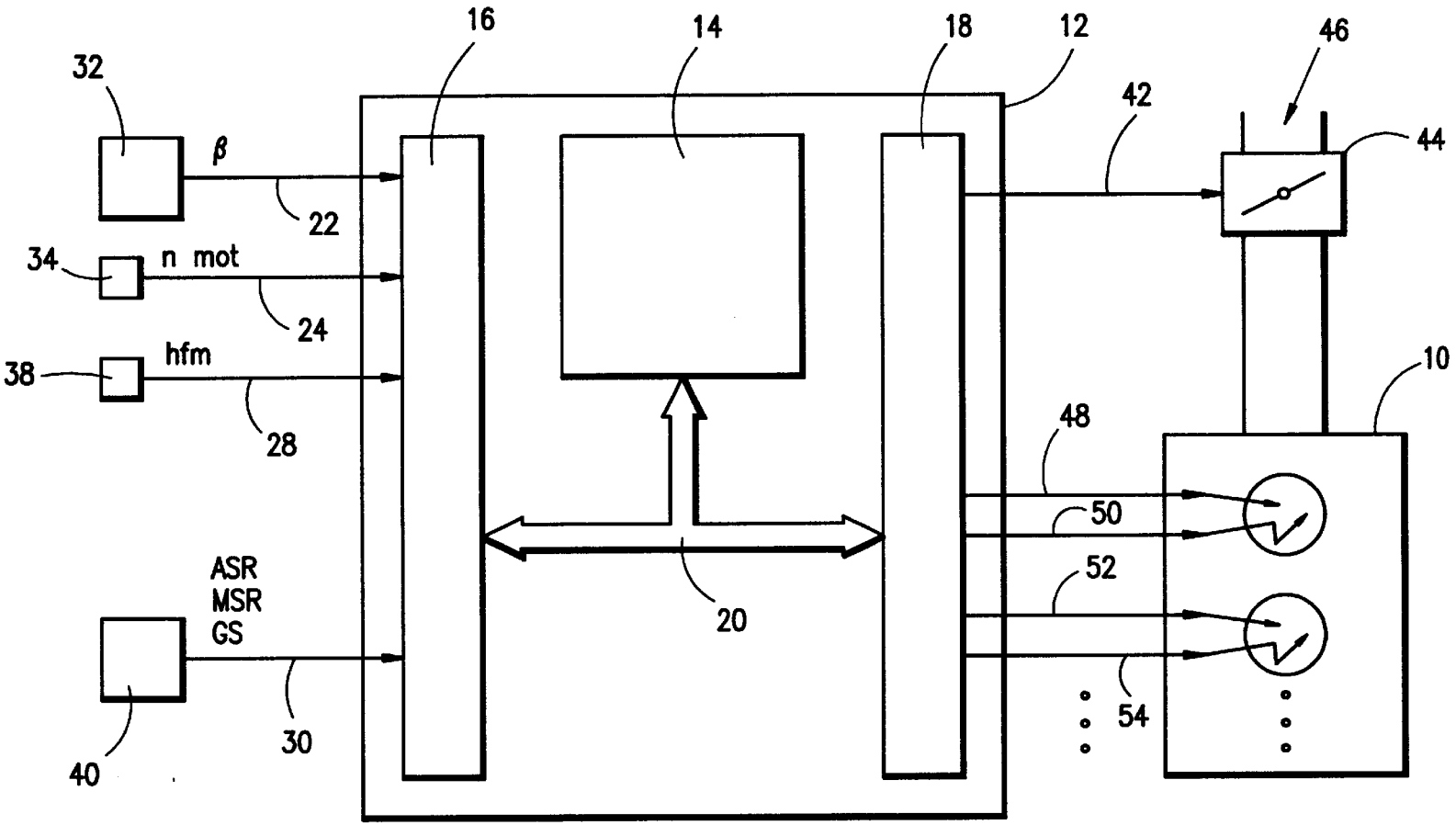
FIG. 1 PRIOR ART
FIG. 1 shows an overview block circuit diagram of a control arrangement for an internal combustion engine; whereas, in FIG. 2, an overview block circuit diagram of a torque-orientated functional architecture of a control system for a drive unit is shown.

In FIG. 1, a control arrangement for a multi-cylinder internal combustion engine 10 is shown. The control arrangement includes an electronic control apparatus 12 which comprises at least one microcomputer 14, an input unit 16 and an output unit 18. Input unit 16, output unit 18, and microcomputer 14 are connected to each other via a communication bus 20 for the mutual exchange of data. The input lines 22, 24, 28 and 30 lead to the input unit 16. The line 22 originates from a measuring unit 32 for detecting the accelerator pedal position β. The line 24 originates from a measuring device 34 for detecting the engine rpm nmot. The line 28 originates at a measuring device 38 for detecting the supplied air mass hfm and the line 30 originates from at least one further control apparatus 40 such as a control apparatus for the drive slip control ASR, for the transmission control GS and/or for the engine drag torque control MSR. For detecting the air mass, and depending upon the embodiment, air mass sensors, air quantity sensors or pressure sensors for detecting the intake manifold pressure or the combustion chamber pressure are provided. In addition to the operating quantity shown, the control unit detects additional quantities which are essential for engine control, such as the engine temperature, road speed, et cetera. An output line 42 is connected to the output unit 18. This output line 42 leads to an electrically actuable throttle flap 44 which is mounted in the air intake system 46 of the engine. Furthermore, output lines 48, 50, 52, 54, et cetera are shown which are connected to adjusting devices for the fuel metering into the cylinders of the engine 10 or are for adjusting the ignition angle in each cylinder.

Figure 2:
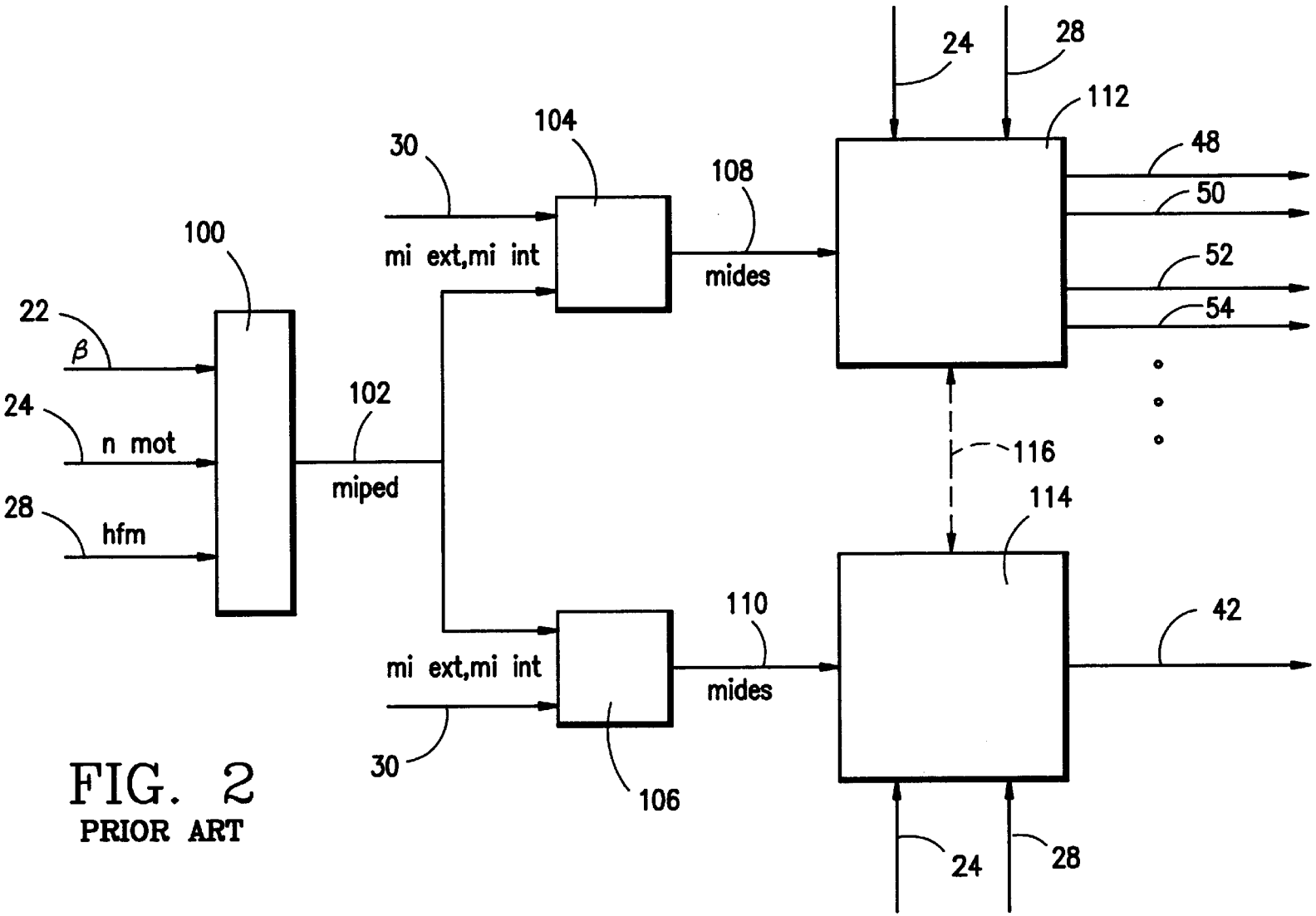
FIG. 2 PRIOR ART

In FIG. 2, the basic elements of a torque-orientated functional architecture of an internal combustion engine control are shown with respect to a block circuit diagram. The elements, which are shown in the block circuit diagram, are parts of the program of the microcomputer in a preferred realization. The blocks represent special program parts having tables, characteristic lines, characteristic fields and/or computation steps.

The input lines 22, 24 and 28 lead to an element 100 for determining the driver command torque miped. This torque is conducted via a line 102 to elements 104 and 106. The line 30 leads to each of elements 104 and 106. The elements 104 and 106 serve for selecting the desired torque values mildes and mides, which are pregiven for the engine control, in accordance with the supplied desired torque values of the driver command as well as external interventions miext (for example, ASR, GS, MSR) and internal interventions miint (for example, rpm limiting, road speed limiting). The selected desired values are supplied via line 108 to computing unit 112 and via line 110 to computing unit 114. The computing unit 112 computes the correction of the ignition angle and/or the injection suppression and/or the influence of the mixture composition in accordance with at least engine rpm and air mass (actual fresh gas charge). In the same manner, the computing unit 114 computes the charge, which is adjusted by driving the throttle flap via the line 42, from the supplied desired value in accordance with at least engine rpm and air mass (actual fresh gas charge). In a preferred embodiment, the computing elements 112 and 114 are connected via the line 116 for the exchange of data.

With the procedure shown in FIG. 2, the various interventions on the torque of the engine (intervention of an ASR, an MSR, a transmission control, from the driver, et cetera) are coordinated by an adjustment of the charge (slow intervention) via a throttle flap in the air intake pipe and/or by adjusting the fuel metering and the ignition angle (more rapid intervention).

The control system, which is shown in FIG. 1, computes power quantities of the engine from its input quantities so that a fault in the region of the computation can lead to excessive drive power of the engine and therefore to a dangerous driving situation. For this reason, and according to FIG. 3, it is provided to check the correctness of the computations supplied for the power control. This takes place in accordance with the initially-mentioned state of the art in that a maximum permissible torque mizul is determined and compared to a computed actual torque miact of the engine and, when the maximum permissible torque is exceeded by the actual torque, fault reactions are executed which are, for example, a switchoff of the fuel metering SKA.

Figure 3:
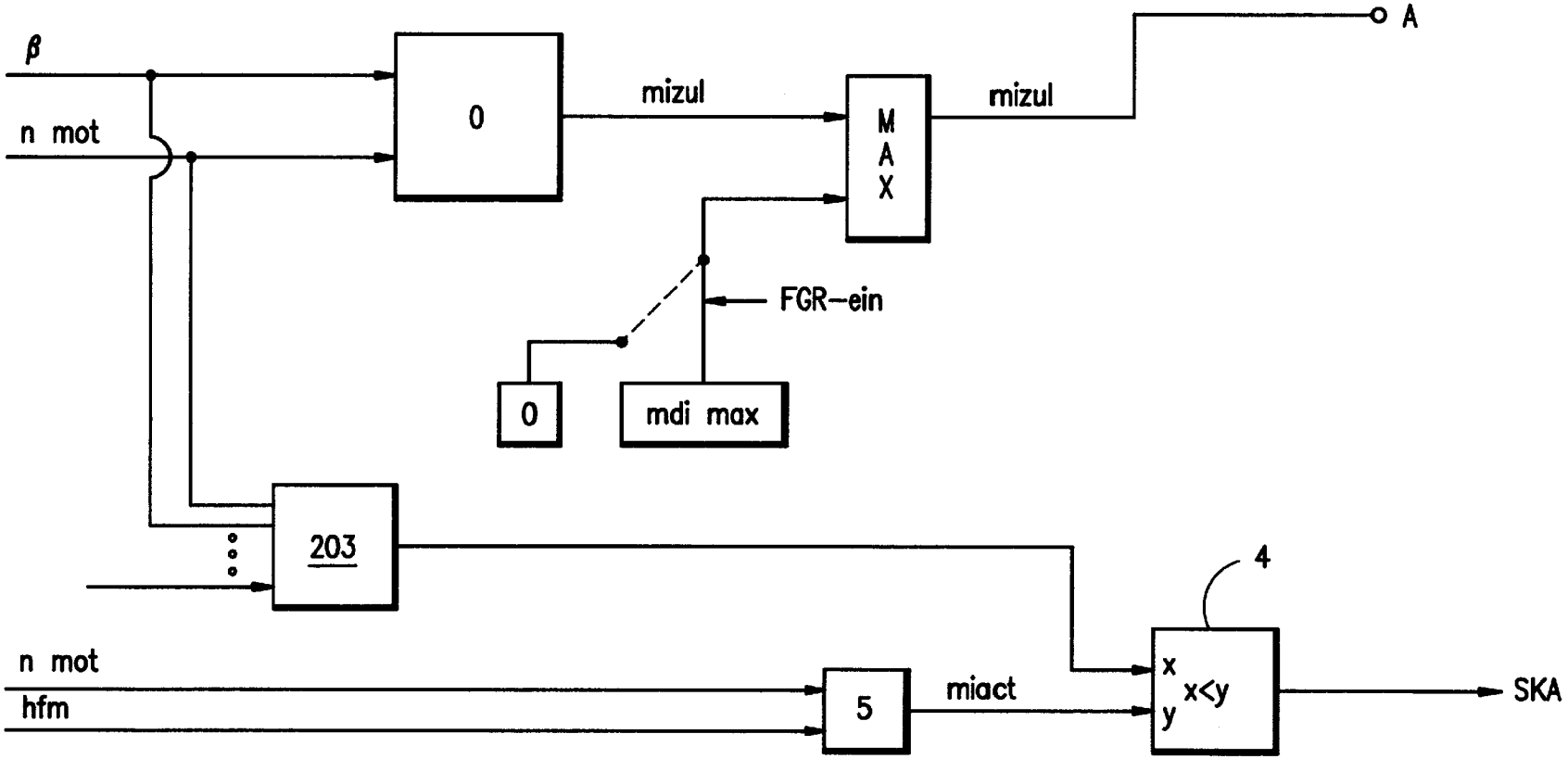
FIG. 3 shows a block circuit diagram for the determination of the maximum permissible torque as well as of the monitoring measures based thereupon.

The procedure, which is selected to determine the maximum permissible torque and to monitor the torque is shown in a preferred embodiment in FIG. 3. Here too, as in the FIGS. that follow, the block circuit diagram is selected for the reasons of clarity and overview. The mentioned functions are realized in the preferred embodiment as programs of the microcomputer of the control unit controlling the engine. The maximum permissible torque mizul is read out in at least one characteristic field 200 on the basis of the input quantities accelerator pedal position β and engine rpm nmot. In the preferred embodiment, this takes place on the basis of the predetermined characteristic field. In the characteristic field, the maximum torque requirement of the pedal, which is permissible at a specific rpm, is stored while considering torque-increasing functions such as, for example, the idle control. The value, which is read out from the characteristic field, is filtered via a lowpass filter (not shown) as shown in the initially mentioned state of the art. The lowpass filter is only active for a negative slope of the value coming from the characteristic field.

In another advantageous embodiment, two characteristic fields are provided dependent upon engine rpm and accelerator pedal position. The maximum permissible torque is here formed as the sum of the two characteristic fields. In one characteristic field, the start and the idle control for rpms below the desired rpm are considered which rpms increase the maximum permissible torque. The filtering then takes place only for the values of the other characteristic field.

The permissible torque mizul, which is determined in this manner, is supplied to a maximum value selector MAX, wherein it is compared to a pregiven fixed value mdimax. This value defines the maximum adjustable torque. The value mdimax is outputted when the road speed controller is active (FGR_in). For a deactivated road speed controller, the value 0 is applied to the corresponding input of the maximum value selector. The larger of the supplied torque values (mizul, mdimax or 0) is further processed as the maximum permissible torque mizul. In this way, it is ensured that in road speed control operation and when the accelerator pedal is released, the maximum permissible torque is not too low and does not respond to the fault reaction. The maximum permissible torque mizul is made available (output A) to limit the desired torques as will be described in FIGS. 4 to 6.

An actual torque results from the maximum permissible desired torque. In a higher-order monitoring level, the actual torque miact is compared to a permissible torque mimax.

This permissible torque is computed in a similar manner as the permissible desired torque. An example for such a computation is described in the state of the art initially mentioned herein. The computation is executed in computation step 203. The maximum permissible torque mimax is, as a rule, greater than the permissible torque mizul which is used for limiting. A filtering (in 203) should here consider the intake pipe time constant, position controller deceleration and torque-increasing functions (for example, dashpot).

If the actual torque miact exceeds the maximum permissible torque mimax (comparator 204), the switchoff of the fuel metering SKA is triggered after a delay time (if required) in order to control the detected fault case. The actual torque miact is computed in 205 at least on the basis of engine rpm nmot and air mass hfm.

Figure 4:
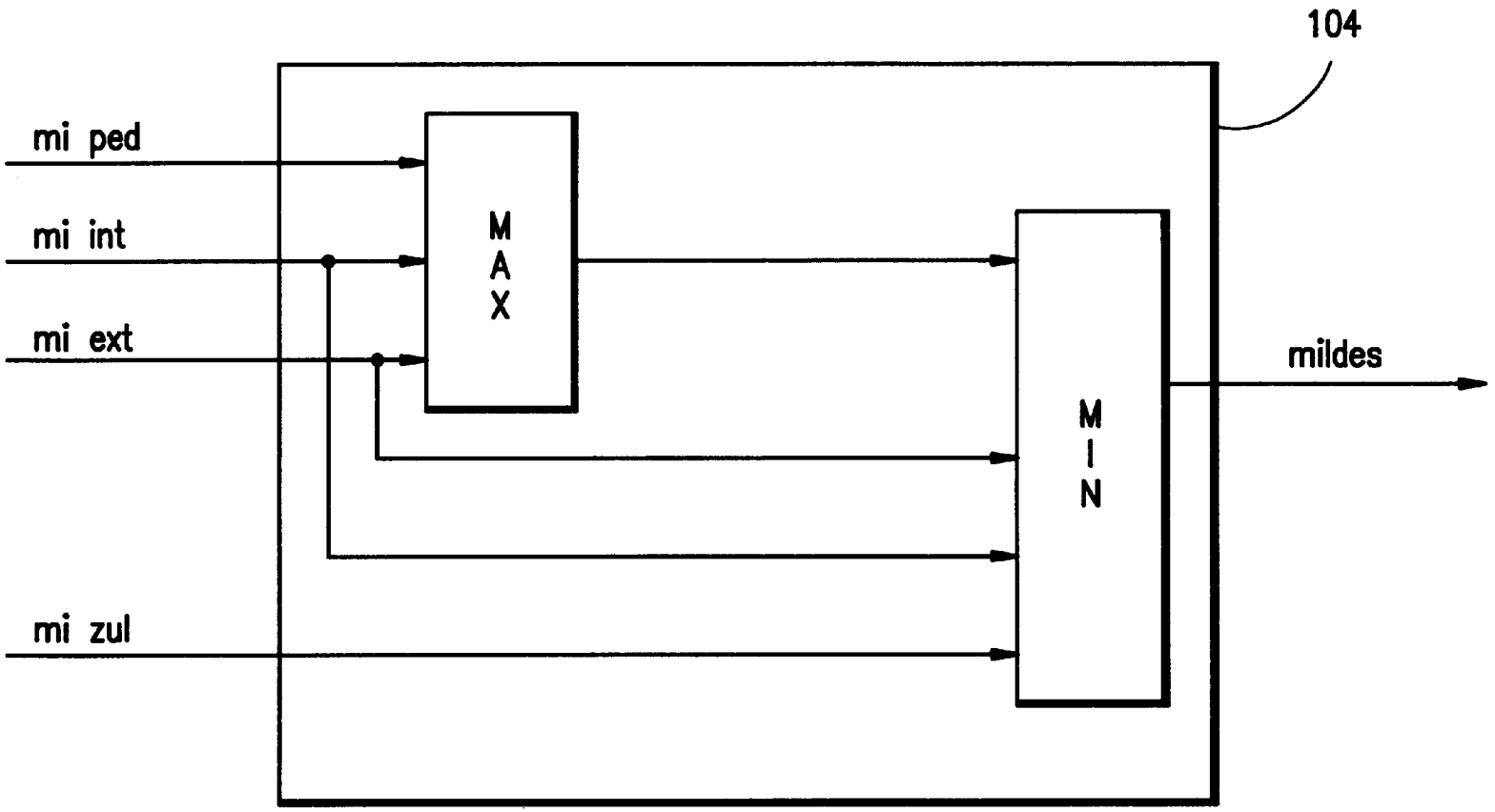
In FIG. 4, the limiting of the desired torque value for the charge path is shown in dependence upon the maximum permissible torque; whereas, in FIGS. 5 and 6, two embodiments for limiting the desired torque to the maximum permissible torque in the rapid intervention path are shown.

In FIG. 4, the limiting of the desired torque value mildes is shown for the charge path. In the preferred embodiment, this is carried out in coordinator 104 in which the pedal torque miped, which is derived from the driver, is compared in a maximum value selector MAX to torque-increasing external and/or internal interventions such as, for example, an MSR. The largest value is then compared in a minimum value selector MIN to torque-reducing external and/or internal interventions such as ASR, an rpm limiting and a road speed limiting. The maximum permissible torque mizul is supplied additionally to this minimum value selector MIN. In each case, the smallest of these desired torques is selected and outputted as desired torque value mides for the charge path. If all torque demands exceed the maximum permissible torque, then this maximum permissible torque is outputted as the desired torque value for the charge path. In this way, the desired torque value mildes for the charge path is limited to the maximum permissible torque mizul.

Figure 5:
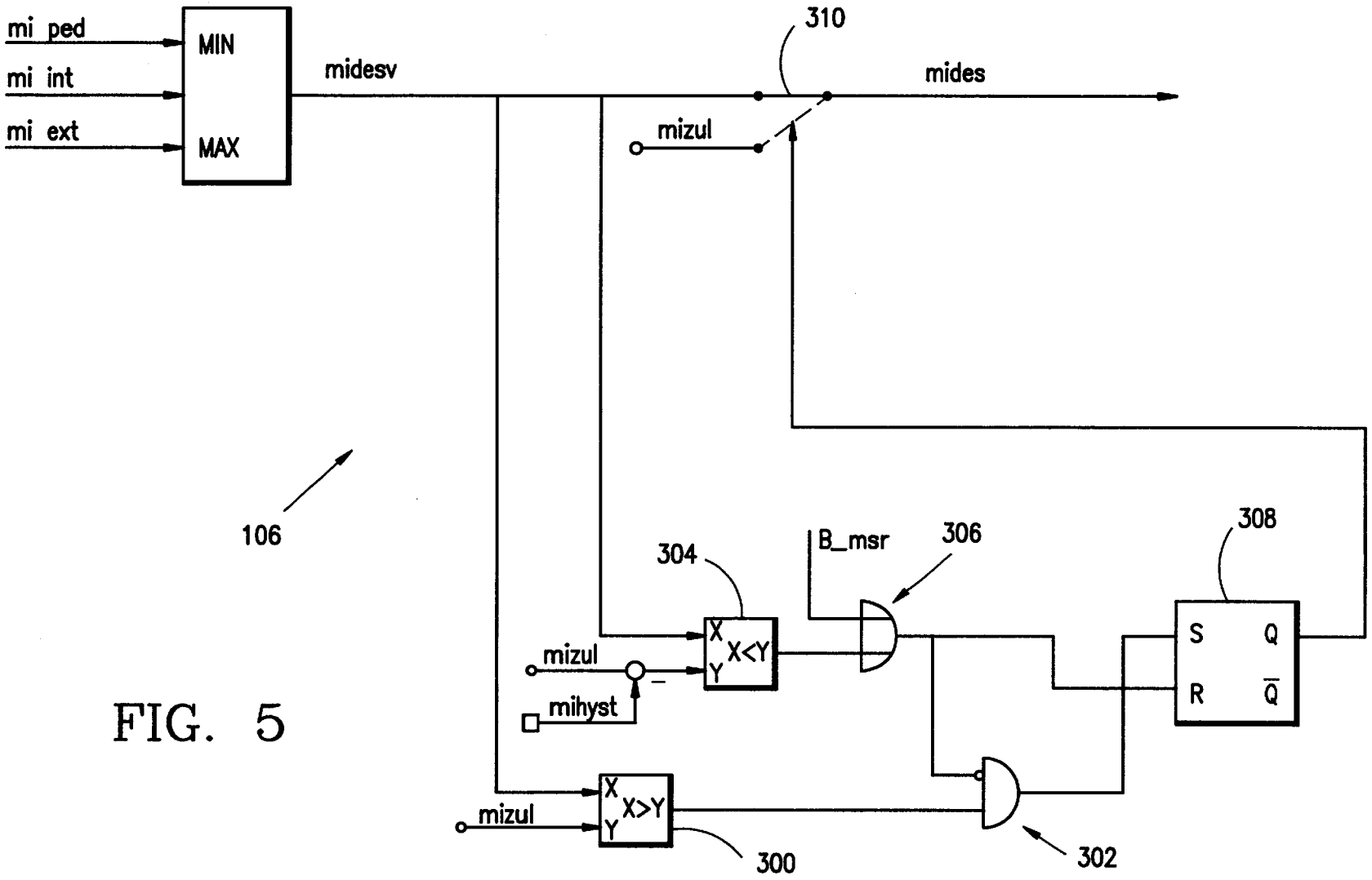

A limiting is also executed in the intervention path synchronous with the crankshaft. FIG. 5 shows a first embodiment of the coordinator 106. First, and in a manner comparable to FIG. 4, the coordinator 106 forms a desired torque midesv for the intervention path synchronous with the crankshaft in a maximum value selector and/or a minimum value selector MIN, MAX from the pedal torque miped, the external desired torque miext and/or the external desired torque miint. The determined desired torque midesv is then compared in a comparator 300 to the permissible torque mizul. If the computed desired torque midesv exceeds the maximum permissible torque mizul, the comparator 300 outputs a logic 1-signal which is supplied to an AND gate 302. Furthermore, the desired torque midesv is supplied to a comparator 304 in which it is compared to a value (mizul-mihyst), which is formed from the maximum permissible torque mizul. This value defines the maximum permissible torque reduced by a pregiven hysteresis torque mihyst. If the desired torque value drops below this value, then a logic 1-signal is outputted to an OR gate 306. The output of the OR gate is supplied to the reset input of an RS flipflop 308 and to the negative input of the AND gate 302. A signal B_msr is also supplied to the OR gate 306 and this signal has a positive signal level when an engine drag torque control is active. The output of the AND gate 302 is supplied to the set input S of the RS flipflop 308. The output signal Q of the flipflop 308 leads to a switching element 310 which goes into a switching state with a corresponding signal. In the switching state, the maximum permissible torque mizul is transmitted further as the desired torque mides for the rapid intervention path in lieu of the desired torque value misolv.

If the desired torque misolv exceeds the maximum permissible torque mizul when the engine drag torque control (B_msr=0) is not active, then the flipflop 308 is set via the AND gate 302. The output Q goes to a "high" level so that the switch 310 switches over the position shown in phantom outline. If the desired torque value drops below the maximum permissible torque reduced by the hysteresis value, then a signal is formed by the comparator 304 which resets the flipflop 308. At the same time, a level change to logic 0 at the set input takes place via the AND gate 302. This has the consequence that the switch 310 is again switched over into the solid-line position via the output Q of the flipflop 308. If the engine drag torque control is active ($B_msr=1$), the reset input of the flipflop 308 is set to logic 1-level via the OR gate 306; whereas, the level 0 is supplied continuously to the set input. In this way, the switch 310 is held in its solid-line position so that, for active engine drag torque control, the desired torque mides can be raised, if required, above the maximum permissible torque mizul.

Figure 6:
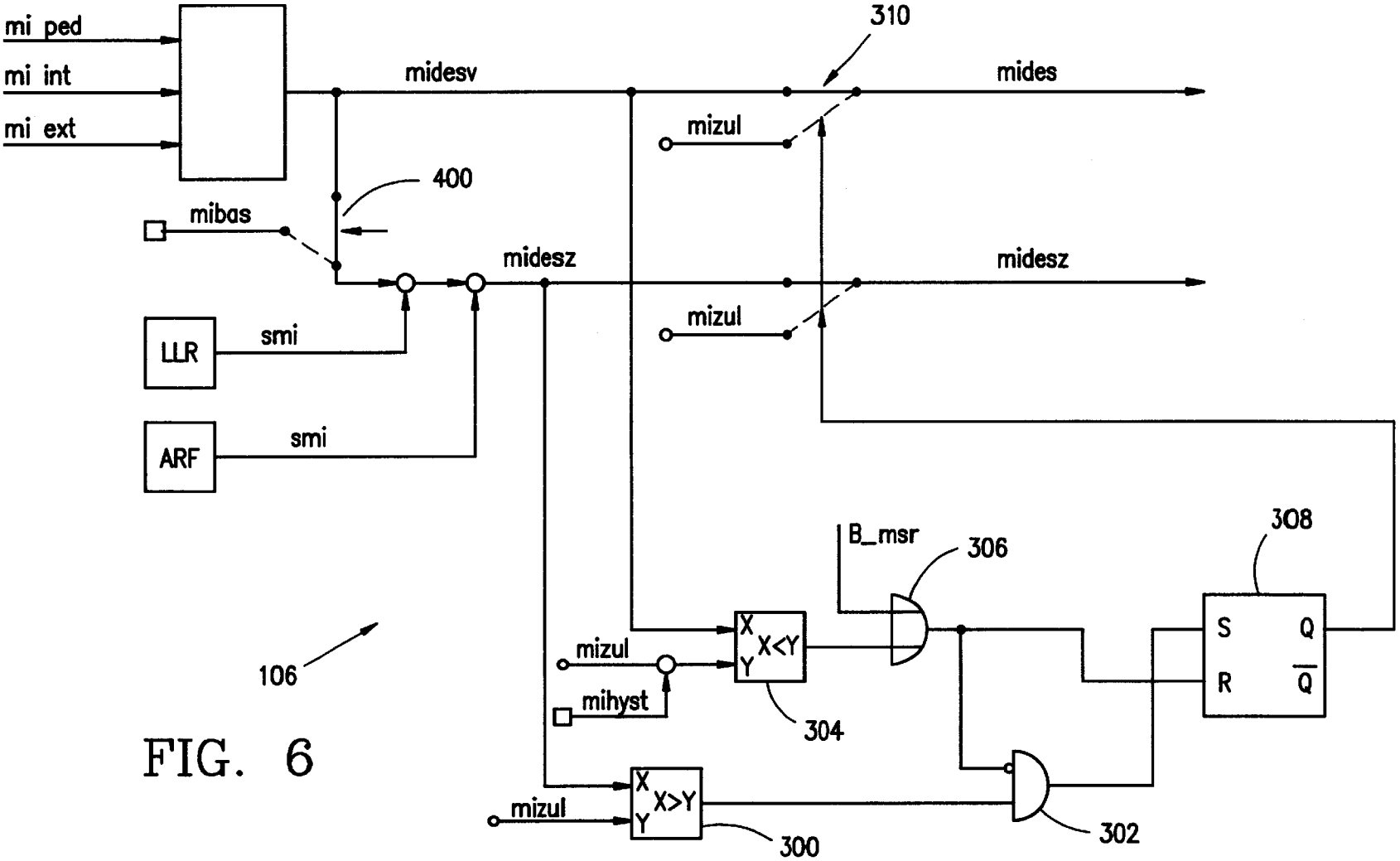

In a preferred embodiment shown in FIG. 6, a desired torque value midesz is derived for the ignition angle intervention from the desired torque value midesv determined by the minimal selection/maximum selection MINMAX. Here, especially additive corrective components Δ mi of an idle control LLR and an antibucking function ARF are considered. The ignition angle desired value is configured so that it can be switched (switch 400) so that, in specific operating situations, not the desired torque value misolv, but a base torque value mibas is used as the basis for the desired torque value formation for the ignition angle. The base torque mibas corresponds to the torque which would be assumed, in the actual operating state, by the engine while considering the preprogrammed ignition angle setting and the λ setting. The base torque is formed on the basis of the air mass hfm, the engine rpm nmot as well as the torque effective lines of the base ignition angle and the λ base setting. The procedure for limiting both desired torque values corresponds to the procedure shown in FIG. 5. The desired torque value for the ignition angle intervention is supplied to the comparator 300 and is thereby applied for deciding whether there should be limiting. In contrast thereto, the desired torque value misolv for the fuel path is supplied to the comparator 304 which decides as to the interruption of the limiting. If the limiting criterion or breakoff criterion is satisfied, then the switching element 310 is correspondingly actuated. For limiting, both desired torque values mides and midesz are replaced by the maximum permissible torque mizul.

The invention was described for a torque orientated function structure. A corresponding procedure is used for an engine control on the basis of power values. Here, the above-mentioned torque value is replaced by the corresponding power quantity which relates to the torque via the rpm.

What is claimed is:

1. A method for controlling a drive unit of a vehicle, the method comprising the steps of:

at least on the basis of a driver command, forming at least a desired value for the torque of the drive unit or at least a desired value for the power of the drive unit;

adjusting at least the one desired value by controlling the drive unit;

determining a maximum permissible torque or a maximum permissible power at least on the basis of the driver command;

limiting the at least one desired value to said maximum permissible torque or said maximum permissible power when the desired value thereof exceeds the maximum permissible value to provide a limited at least one desired value; and, controlling the drive unit according to said limited at least one desired value.

2. The method of claim 1, wherein the at least one desired value is a desired torque value or a desired power value which is adjusted by influencing the charge of an internal combustion engine.

3. The method of claim 2, wherein the desired value for the charge path is limited to the maximum permissible value in that a minimum value selection is carried out between the quantities, which form the desired value, and the maximum permissible value.

4. The method of claim 1, wherein the at least one desired value is a desired torque value or a desired power value for crankshaft synchronous interventions such as fuel metering and ignition angle.

5. The method of claim 4, wherein the desired value is compared to the maximum permissible value, and as desired value, the maximum permissible value is transmitted further when the desired value exceeds the maximum permissible value.

6. The method of claim 5, wherein the limiting is switched off when the desired value drops below a pregiven value which is derived from the maximum permissible value.

7. The method of claim 6, wherein the limiting is deactivated when an engine drag torque control is active.

8. The method of claim 7, wherein a desired value for the fuel metering is determined and, while considering additional interventions, a desired value for the ignition angle path is determined; the limiting is triggered when the desired value for the ignition angle exceeds the maximum permissible value and the limiting is disabled when the desired value for the fuel metering drops below a pregiven value.

9. The method of claim 1, wherein a further maximum permissible torque or a maximum permissible power is compared to a computed actual torque of the drive unit or of a computed actual power and a fault reaction is initiated when the actual value exceeds the maximum permissible value.

10. An arrangement for controlling a drive unit of a vehicle, the arrangement comprising:

means for determining at least one desired torque value of the drive unit or at least one desired value for the power of the drive unit for controlling the drive unit at least in dependence upon a driver command;

means determining a maximum permissible torque value or a maximum permissible power value at least in dependence upon the driver command;

means for limiting the at least one desired value to the maximum permissible value when the desired value exceeds the maximum permissible value to provide a limited at least one desired value; and, means for controlling the torque or the power of said drive unit according to said limited at least one desired value.

* * * * *